US007170458B1

(12) United States Patent
Weinstein

(10) Patent No.: US 7,170,458 B1
(45) Date of Patent: Jan. 30, 2007

(54) INFLATABLE ANTENNA SYSTEM

(75) Inventor: Eliahu Weinstein, San Diego, CA (US)

(73) Assignee: AvalonRF, Inc., El Cajon, CA (US)

( * ) Notice: Subject to any disclaimer, the term of this patent is extended or adjusted under 35 U.S.C. 154(b) by 15 days.

(21) Appl. No.: 11/175,719

(22) Filed: Jul. 6, 2005

(51) Int. Cl.
*H01Q 1/28* (2006.01)
*H01Q 1/34* (2006.01)

(52) U.S. Cl. ..... 343/706; 343/709; 342/8; 342/10

(58) Field of Classification Search ..... 343/706, 343/709; 342/7, 8, 9
See application file for complete search history.

(56) References Cited

U.S. PATENT DOCUMENTS 3,354,458 A * 11/1967 Rottmayer ..... 342/10
4,475,109 A * 10/1984 Dumas et al. ..... 343/709
5,132,699 A * 7/1992 Rupp et al. ..... 343/880
6,115,003 A * 9/2000 Kozakoff ..... 343/840
6,373,449 B1 * 4/2002 Bokulic et al. ..... 343/915
6,650,304 B2 * 11/2003 Lee et al. ..... 343/915
6,791,510 B2 * 9/2004 Watanabe et al. ..... 343/897
6,963,315 B2 * 11/2005 Gierow et al. ..... 343/872

* cited by examiner

*Primary Examiner*—Hoang V. Nguyen
(74) *Attorney, Agent, or Firm*—Richard D. Clarke

(57) ABSTRACT

The present invention involves an inflatable antenna system including an inflatable antenna and a mounting plate. The inflatable antenna includes an inflatable cone or cylinder and a plurality of conductors integrated therein. The mounting plate can be incorporated into a protective enclosure that holds and protects the inflatable antenna during transport, supports it during use, and provides a means for mounting it to a mast. The mounting plate serves as a mounting surface for the inflatable antenna, a radio frequency (RF) connector, an air intake valve, and an impedance matching network. Selected surfaces of the protective enclosure can be coated with conductive materials. An air intake valve allows for inflation and deflation of the inflatable antenna. Inflatable support members can be used in conjunction with a stabilizing portion comprised of a vertical member and attached weight, to allow the inflatable antenna system to be deployed in water.

20 Claims, 2 Drawing Sheets

INFLATABLE ANTENNA SYSTEM

FIELD OF THE INVENTION

The present invention relates generally to inflatable antenna structures, and more particularly to an integrated conductor and inflatable cone or cylinder which may be both quickly deployed and quickly folded, providing a relatively lightweight and compact antenna for highly mobile military and public safety applications.

BACKGROUND OF THE INVENTION

Inflatable antennae have been described in prior art. One such inflatable antenna is described in U.S. Pat. No. 6,650,304 B2. This novel invention describes an antenna that includes an inflatable envelope, a cylindrical reflector formed on a wall of the envelope, a support frame for maintaining the cylindrical shape of the cylindrical reflector and a feed array support structure connected to the catenary support frame. While this invention incorporates a reflective coating utilizing a rigid support frame, there is no integrated antenna, thereby providing for effective relay of information to a separate receiver, but without the ability to receive and decrypt radio frequency. Additionally, the necessity for a rigid structure requires a good deal of space for transport, weight for transport, and additional time for set up. Thus, it would be highly desirable to have an inflatable antenna which would incorporate an antenna printed or wired on an inflatable structure made of flexible radio frequency grade material which would require no additional rigid support to maintain the structural integrity required with a reflective surface antenna.

U.S. Pat. No. 6,373,449 B1 describes an invention which again utilizes a reflective surface. This requires use of a rigidizing structure and possibly a sub-reflector feed system to correct for surface shape deformations of the inflatable antenna. Thus, it would be highly desirable to have an inflatable antenna which would not need a rigidizing structure or the related correction for surface shape deformations of a reflector surface and which would provide an integrated antenna on an inflatable structure for ease and quickness of deployment.

U.S. Pat. No. 6,115,003 describes a unique invention which may be both reflective and transmissive of plane waves. However, this apparatus utilizes a rigid frame, which again must be erected prior to placement of an inflatable envelope. This erection of a rigid frame would be time consuming, require additional tools for erection and would also prove to be cumbersome. Thus, it would be highly desirable to have an antenna that could be incorporated into an inflatable structure, which would then serve as the structural component itself, without the necessity of an additional rigid structure being erected, saving both time and effort in deployment of the antenna.

The novel invention described in U.S. Pat. No. 5,132,699 utilizes a panel that comprises planar members made up of multiple tubular members with web partitions. The described antenna appears to be bulky, difficult to transport, erect and dismantle, and generally looks awkward to deploy. Thus, it would be highly desirable to provide an antenna that would have no multiple tubular members or web partitions, be easy to deploy and dismantle, would not require an additional rigidizing frame, and that could be utilized multiple times.

The invention described in U.S. Pat. No. 4,475,109 has an inflatable component and a separate antenna component. It would be highly desirable to have both the inflatable component and antenna component as a single unit for ease of deployment and dismantling and to decrease weight and space requirements for transport and storage.

In this respect, before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. In addition, it is to be understood that the phraseology and terminology employed herein are for the purpose of description and should not be regarded as limiting.

SUMMARY OF THE INVENTION

The principle advantage of this invention is to create an antenna printed or wired on an inflatable cylinder or cone made of flexible radio frequency grade material for use in highly mobile military and public safety applications.

Another advantage of this invention is to create an antenna with integrated inflatable component together with a conductive mounting plate.

Another advantage of this invention is to create an inflatable antenna with an RF connector.

A further advantage of this invention is to create an inflatable antenna with an air intake valve attached thereto.

Another advantage of this invention is to create an inflatable antenna which may be easily deflated and stowed for reuse.

And yet another advantage of this invention is to add an RF feed line which may be integrated into the antenna.

These advantages, together with other advantages of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated the preferred embodiments of the invention.

The preferred embodiment of the present invention involves an inflatable antenna system including an inflatable antenna and a mounting plate. The inflatable antenna includes an inflatable cone or cylinder and a plurality of conductors integrated therein. The mounting plate can be incorporated into a protective enclosure that holds and protects the inflatable antenna during transport, supports it during use, and provides a means for mounting it to a mast. The mounting plate serves as a mounting surface for the inflatable antenna, a radio frequency (RF) connector, an air intake valve, and an impedance matching network. Selected surfaces of the protective enclosure, including the mounting plate, can be coated with conductive materials to create an electrical ground plane and/or serve as an RF reflector. An air intake valve allows for inflation and deflation of the inflatable antenna.

A first alternate embodiment of the present invention involves an inflatable antenna system that can be deployed in water. The inflatable antenna system includes a wide band, hemispheric log, spiral inflatable antenna, a mounting plate, one or more inflatable members, and a stabilizing portion. The inflatable antenna includes an inflatable cone and a plurality of conductors that can be printed, glued, or woven therein. The inflatable cone can be comprised of highly flexible microwave quality composite material, such as Kapton®. A mounting plate is attached to the inflatable cone. An RF feed line is mounted to mounting plate. A feed point is located at the apex of inflatable cone, and serves as a location where a signal can be transmitted and received. An air intake valve and an RF Connector are also mounted on the mounting plate. An inflatable member is used to ensure that the inflatable antenna remains at the surface of any body of water. A stabilizing portion that includes an arm and a weight attached thereto, is attached to the mounting plate and serves to stabilize the inflatable antenna when it is deployed in water.

A second alternative embodiment of the invention describes an inflatable antenna which may be utilized with off road vehicles, such as quads, for both recreational and law enforcement purposes.

It must be clearly understood that while the preferred embodiment of the invention consists of inflatable antenna means, many conventional inflatable antennae devices exist that can achieve a similar operation, and these devices will also be fully covered within the scope of this patent.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

BRIEF DESCRIPTION OF THE DRAWINGS

The accompanying drawings, which are incorporated in and form a part of this specification, illustrate embodiments of the invention and together with the description, serve to explain the principles of this invention, wherein.

For a fuller understanding of the nature and advantages of the invention, reference should be had to the following detailed description taken in conjunction with the accompanying drawings which are incorporated into and form a part of this specification, illustrate embodiments of the invention, and together with the description, serve to explain the principles of this invention.

DETAILED DESCRIPTION OF THE PREFERRED EMBODIMENTS

Figure 1:
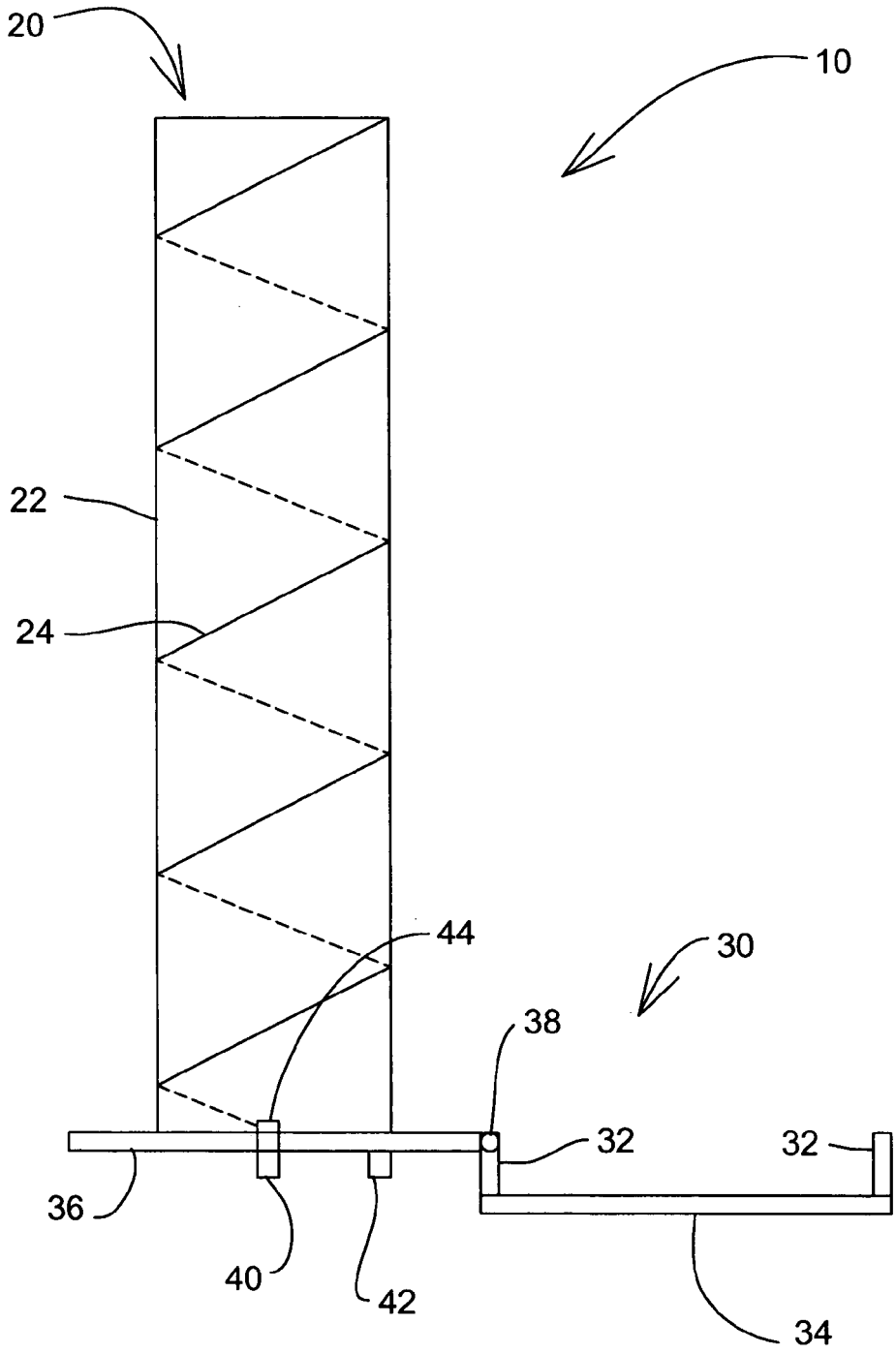
FIG. 1 depicts a side view of the preferred embodiment of the inflatable antenna system, including a wide band, narrow viewing angle, helical inflatable antenna device and supporting enclosure, constructed in accordance with the present invention.

Referring now to the drawings, wherein similar parts are identified by like reference numerals, there is seen in FIG. 1 a side view of the preferred embodiment of the inflatable antenna system 10. Inflatable antenna system 10 includes a wide band, narrow viewing angle, helical inflatable antenna 20 and a protective enclosure 30. Inflatable antenna 20 includes an inflatable member 22 and a plurality of conductors 24. Inflatable member 22 can be comprised of highly flexible microwave quality composite material, such as Kapton®. Although inflatable member 22 can take the form of many shapes, the preferred shape of inflatable member 22 is cylindrical. Conductors 24 are antenna elements that can be integrated into inflatable member 22 by methods including, but not limited to, printing, gluing, or weaving, to meet antenna topology requirements and/or provide high quality (Q) at the spectrum of operation of the inflatable antenna 20.

Protective enclosure 30 is rectangular in shape, containing four side walls 32 (only 2 shown), a bottom surface 34, a mounting plate 36, and a hinge 38. Protective enclosure 30 serves to hold and protect inflatable antenna 20 during transport, to support inflatable antenna 20 during use, and to provide a means for mounting inflatable antenna system 10 to a mast. It is to be recognized that protective enclosure 30 can embody various shapes and sizes, as well as utilize various mechanisms to attach mounting plate 36 to protective enclosure 30, including, but not limited to, pin, screw, and other mechanisms as would be recognized by one with ordinary skill in the art. Mounting plate 36 serves as a mounting surface for inflatable antenna 20, radio frequency (RF) connector 40, air intake valve 42, and impedance matching network 44. Selected surfaces of protective enclosure 30, including mounting plate 36, can be coated with conductive materials to create an electrical ground plane and/or serve as an RF reflector. RF Connector 40 provides feed for conductors 24 through impedance matching network 44. Air intake valve 42 allows for inflation and deflation of inflatable antenna 20.

Figure 2:
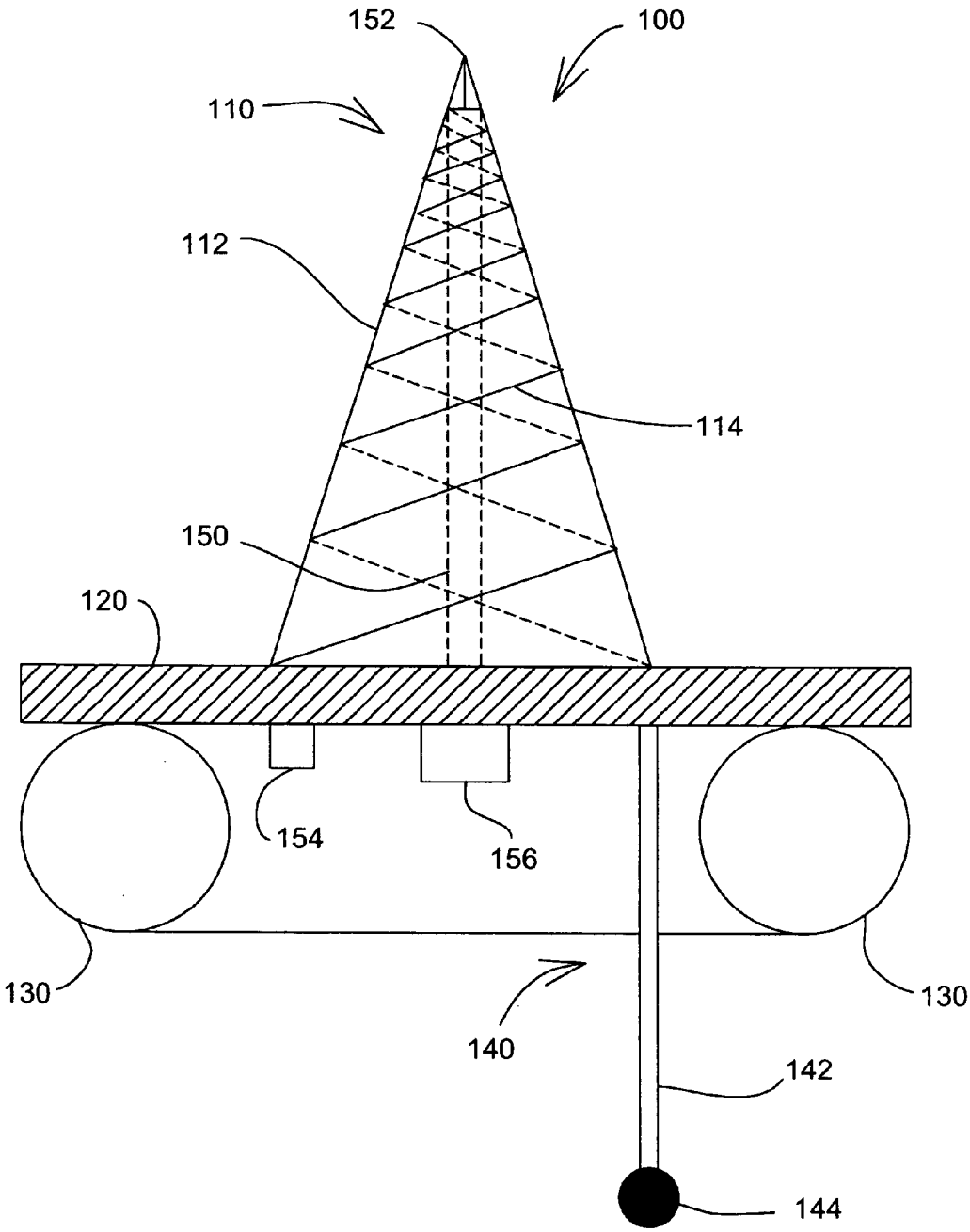
FIG. 2 depicts a side view of an alternate embodiment of the inflatable antenna system that allows for deployment in water, including a wide band hemispheric log spiral inflatable antenna, one or more inflatable support devices, and a stabilizer arm, constructed in accordance with the present invention.

As illustrated in FIG. 2, there is depicted a side view of an alternate embodiment of the inflatable antenna system 100 that allows for deployment in water. Inflatable antenna system 100 includes a wide band, hemispheric log, spiral inflatable antenna 110, a mounting plate 120, one or more inflatable support members 130, and a stabilizing portion 140. Inflatable antenna 110 includes an inflatable member 112 and a plurality of conductors 114. Inflatable member 112 can be comprised of highly flexible microwave quality composite material, such as Kapton®. Although inflatable member 112 can take the form of many shapes, the preferred shape of inflatable member 112 is conical. Conductors 114 are antenna elements that can be integrated into inflatable member 112 by methods including, but not limited to, printing, gluing, or weaving, to meet antenna topology requirements and provide high quality (Q) at the spectrum of operation of the inflatable antenna 110.

Mounting plate 120 is attached to inflatable member 112. Mounting plate 120 can be coated with conductive materials to create an electrical ground plane and/or serve as an RF reflector. An RF feed line 150 is coupled to mounting plate 120. A feed point 152 is located at the apex of inflatable cone 112, and serves as a location where a signal can be transmitted and received. An air intake valve 154 and an RF Connector 156 are also mounted on mounting plate 120. Inflatable member 130 is used to ensure that inflatable antenna 110 remains at the surface of any body of water. It is to be recognized that inflatable member 130 can be comprised of a buoy, a tube, or other receptacle capable of storing air. Stabilizing portion 140 includes an arm 142 and a weight 144, and serves to stabilize inflatable antenna 110 when it is deployed in water.

The inflatable antenna system shown in the drawings and described in detail herein disclose arrangements of elements of particular construction and configuration for illustrating preferred embodiments of structure and method of operation of the present invention. It is to be understood however, that elements of different construction and configuration and other arrangements thereof, other than those illustrated and described may be employed for providing an inflatable antenna in accordance with the spirit of this invention, and such changes, alternations and modifications as would occur to those skilled in the art are considered to be within the scope of this invention as broadly defined in the claims.

Further, the purpose of the foregoing abstract is to enable the U.S. Patent and Trademark Office and the public generally, and especially the scientists, engineers and practitioners in who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. An inflatable antenna system comprising:

a) a mounting plate, b) an inflatable antenna member coupled to said mounting plate, said inflatable antenna member containing a plurality of conductors for the purpose of meeting antenna topology requirements and providing high quality at the spectrum of operation of the inflatable antenna system;

c) an air intake valve coupled to said mounting plate for the purpose of allowing inflation and deflation of said inflatable antenna member; and d) a radio frequency connector coupled to said mounting plate for the purpose of providing feed to said plurality of conductors through an impedance matching network.

2. The inflatable antenna system of claim 1, wherein said mounting plate is incorporated into a protective enclosure.

3. The inflatable antenna system of claim 2, wherein said mounting plate is incorporated into said protective enclosure by use of a hinge.

4. The inflatable antenna system of claim 1, wherein said mounting plate is coated with conductive materials for the purpose of creating an electrical ground plane.

5. The inflatable antenna system of claim 1, wherein said mounting plate is coated with conductive materials for the purpose of allowing said mounting plate to serve as a radio frequency reflector.

6. The inflatable antenna system of claim 1, wherein said inflatable antenna member is cylindrical in shape.

7. The inflatable antenna system of claim 1, wherein said inflatable antenna member is spherical in shape.

8. The inflatable antenna system of claim 1, wherein said plurality of conductors are printed, glued, or woven to said inflatable antenna member.

9. The inflatable antenna system of claim 1 further comprising a radio frequency feed line coupled to said mounting plate for the purpose of increasing feed to said conductors.

10. The inflatable antenna system of claim 1, wherein said inflatable antenna member is a wide band, narrow viewing angle, helical inflatable antenna.

11. An inflatable antenna system comprising:

a) a mounting plate, said mounting plate containing a first side and a second side;

b) an inflatable antenna member coupled to said first side of said mounting plate, said inflatable antenna member containing a plurality of conductors coupled to said inflatable antenna member for the purpose of meeting antenna topology requirements and providing high quality at the spectrum of operation of the inflatable antenna system;

c) an air intake valve coupled to said inflatable antenna member for the purpose of allowing inflation and deflation of said inflatable antenna member;

d) one or more inflatable support members coupled to said second side of said mounting plate for the purpose of supporting the inflatable antenna system when deployed in water; and e) a radio frequency connector coupled to said mounting plate for the purpose of providing feed to said plurality of conductors through an impedance matching network.

12. The inflatable antenna system of claim 11 further comprising a means for stabilizing the inflatable antenna system when deployed in water.

13. The inflatable antenna system of claim 11, wherein said means for stabilizing the inflatable antenna system when deployed in water includes a vertical member coupled to said mounting plate and a weight coupled the distal end of said vertical member.

14. The inflatable antenna system of claim 11, wherein said one or more inflatable support members is tubular in shape.

15. The inflatable antenna system of claim 11, wherein said mounting plate is coated with conductive materials for the purpose of creating an electrical ground plane.

16. The inflatable antenna system of claim 11, wherein said mounting plate is coated with conductive materials for the purpose of allowing said mounting plate to serve as a radio frequency reflector.

17. The inflatable antenna system of claim 11, wherein said inflatable antenna member is a wide band, hemispherical log, spiral inflatable antenna.

18. The inflatable antenna system of claim 11, wherein said inflatable antenna member is conical in shape.

19. A method of making an inflatable antenna system comprising the steps of:

a) providing a mounting plate, b) providing an inflatable antenna member that can be coupled to said mounting plate, said inflatable antenna member containing a plurality of conductors coupled to said inflatable antenna member for the purpose of meeting antenna topology requirements and providing high quality at the spectrum of operation of the inflatable antenna system;

c) coupling said inflatable antenna member to said mounting plate;

d) providing an air intake valve that can be coupled to said mounting plate for the purpose of allowing inflation and deflation of said inflatable antenna member;

e) coupling said air intake valve to said mounting plate;

f) providing a radio frequency connector that can be coupled to said mounting plate for the purpose of providing feed to said plurality of conductors through an impedance matching network; and g) coupling said radio frequency connector to said mounting plate.

20. The method of making an inflatable antenna system of claim 19 further comprising the steps of:

a) providing one or more inflatable support members that can be coupled to said mounting plate for the purpose of supporting the inflatable antenna system when deployed in water; and b) coupling said one or more inflatable support members to said mounting plate.

* * * * *